US006132275A

United States Patent [19]

Tanaka et al.

[11] Patent Number: 6,132,275

[45] **Date of Patent: *Oct. 17, 2000**

[54] LUBRICATING OIL MANAGING ARRANGEMENT FOR AN OUTBOARD MARINE DRIVE ENGINE

[75] Inventors: Mitsuharu Tanaka; Hiroshi Mizuguchi, both of Wako, Japan

[73] Assignee: Honda Giken Kogyo Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/151,494

[22] Filed: Sep. 11, 1998

[30] Foreign Application Priority Data

Sep. 12, 1997 [JP] Japan ..... 9-249166

[51] Int. Cl.[7] ..... B63H 21/10

[52] U.S. Cl. ..... 440/88; 123/196 R

[58] Field of Search ..... 440/88, 2; 123/73 AD, 123/196 R, 198 R; 116/276; 73/327

[56] References Cited

U.S. PATENT DOCUMENTS 4,625,549 12/1986 Mahoney ..... 73/327
4,757,710 7/1988 Haynes ..... 440/88
5,555,857 9/1996 Kanno ..... 123/73 AD

FOREIGN PATENT DOCUMENTS 59-195095 12/1984 Japan .
1-83117 6/1989 Japan .

*Primary Examiner*—Jesus D. Sotelo
*Attorney, Agent, or Firm*—Skjerven Morrill MacPherson LLP; Alan H. MacPherson

[57] ABSTRACT

In an outboard marine drive, a tubular socket member is sealingly fitted into an opening formed on one side of the crankcase of the engine at a level corresponding to a normal engine lubricating oil level, and a transparent window member is sealingly fitted into an outer end of the tubular socket member. An engine cover covering the engine is provided with an opening aligned with the transparent window member so as to allow the level of lubricating oil in the crankcase to be inspected from outside the engine cover. The socket member may also be provided with an oil filler pipe bifurcating upwardly from the socket member at an oblique angle, and an oil drain pipe bifurcating downwardly from the socket member at an oblique angle so that filling and removing lubricating oil into and out of the crankcase of the engine can be easily accomplished without complicating the structure for managing engine lubricating oil.

5 Claims, 4 Drawing Sheets

LUBRICATING OIL MANAGING ARRANGEMENT FOR AN OUTBOARD MARINE DRIVE ENGINE

TECHNICAL FIELD

The present invention relates to an outboard marina drive, and in particular an arrangement for managing lubricating oil for an internal combustion engine of an outboard marine drive.

BACKGROUND OF THE INVENTION

Four-stroke engines are increasingly preferred for use in outboard marine drives with the aim of reducing emission to keep the environment pollution-free. However, four-stroke engines require lubricating oil stored in an oil pan at a proper level for their operation, and it is therefore necessary to provide means for inspecting the level of lubricating oil. In small four-stroke engines typically used for portable power generators and lawnmowers, the oil level is inspected by -using an oil gauge rod or a dip stick which is passed into an oil filler tube extending upward from an oil pan. Draining of lubricating oil is typically accomplished by tilting the engine, and letting the lubricating oil flow out of the oil filler tube (refer to Japanese UM laid-open (kokai) publication No. 1-83117).

This approach however is not suited for outboard marine drive engines because the outboard marine drives have relatively large lengths and cannot be readily detached from the boat. Therefore, there has been a need to provide a convenient arrangement for managing lubricating oil for small outboard marine drive engines which is simple but convenient to use.

BRIEF SUMMARY OF THE INVENTION

In view of such problems in the prior art and the recognition of the problems by the inventors, a primary object of the present invention is to provide an outboard marine drive engine having a simple but convenient arrangement for managing lubricating oil.

A second object of the present invention is to provide an outboard marine drive engine which allows filling and draining of engine lubricating oil to be conducted in a simple fashion.

A third object of the present invention is to provide an outboard marine drive engine which allows the level of engine lubricating oil to be inspected in a simple fashion.

According to the present invention, these and other objects can be accomplished by providing an outboard marine drive having an internal combustion engine covered by an engine cover, comprising: an opening formed in a crankcase of the engine centered to a normal lubricating oil level of the engine; a tubular socket member sealingly connected to the opening of the crankcase; and a transparent window member sealingly fitted into an outer end of the tubular socket member; wherein the engine cover is provided with an opening aligned with the transparent window member to allow a level of lubricating oil in the crankcase to be inspected from outside the engine cover.

Thus, the level of engine lubricating oil can be easily inspected by viewing through the transparent window member even without removing the engine cover or using a dip stick or the like. The socket member may be additionally integrally provided with an oil filler pipe bifurcating upwardly from the socket member at an oblique angle, and an oil drain pipe bifurcating downwardly from the socket member at an oblique angle. Thus, filling of lubricating oil can be readily accomplished by removing a plug which may be fitted into the oil filler pipe and pouring oil into the oil filler pipe by removing the engine cover or without requiring the removal of the engine cover depending on the associated arrangement of the engine cover. Also, draining of lubricating oil can be accomplished by removing a plug which may be fitted into the oil drain pipe and tilting the outboard marine drive with its lower end up while twisting the outboard marine drive around its swivel case so as to face the side of the outboard marine drive fitted with the socket member downward. Therefore, draining of lubricating oil can be accomplished without removing the engine cover by appropriately providing an opening in a suitable part of the engine cover while keeping the outboard marine drive attached to the boat.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
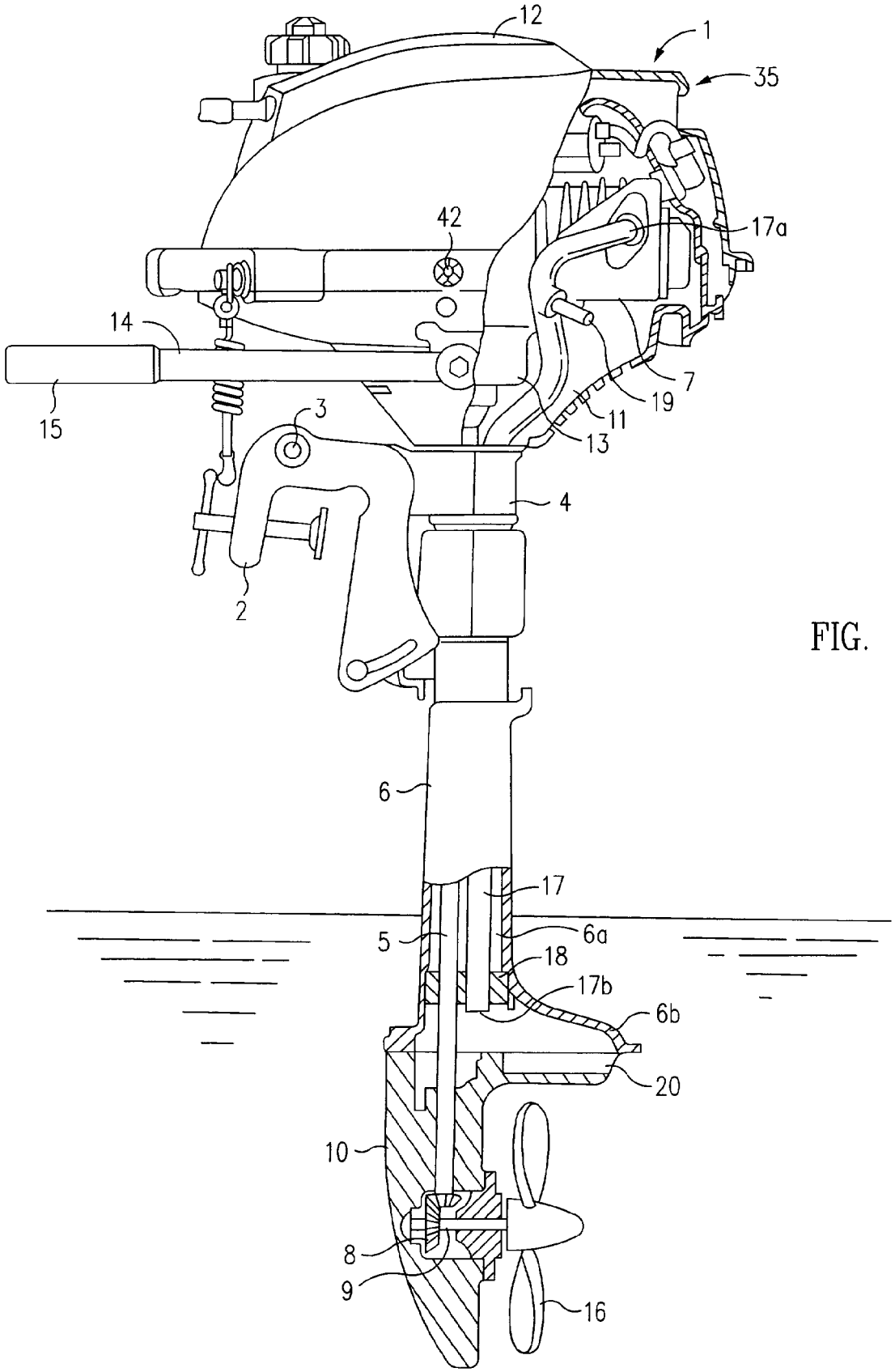
FIG. 1 is a partly broken-away side view of an outboard marine drive embodying the present invention.

FIG. 1 generally illustrates a side view of an outboard marine drive embodying the present invention. This outboard marine drive 1 is adapted to be attached to a transom of a boat (not shown in the drawing) with a stem bracket 2 having a clamping capability. To the stem bracket 2 is attached a swivel case 4 via a tilt shaft 3 extending horizontally across the width of the boat. The swivel case 4 in turn supports a tubular extension case 6 accommodating therein a vertically extending drive shaft 5. The swivel case 4 permits the main part of the outboard marine drive to rotate 360 degrees around a vertical steering axis relative to the stern bracket 2 or the boat.

The upper end of the extension case 6 is attached to an integral combustion engine 7, and the lower end 6*b* of the extension case 6 is attached to & gear case 10 accommodating, in the interior 6*a* of the extension case 6, a propeller shaft 9 and a bevel gear mechanism 8 for transmitting the rotative power from the lower end of the drive shaft 5 to the propeller shaft 9.

Figure 2:
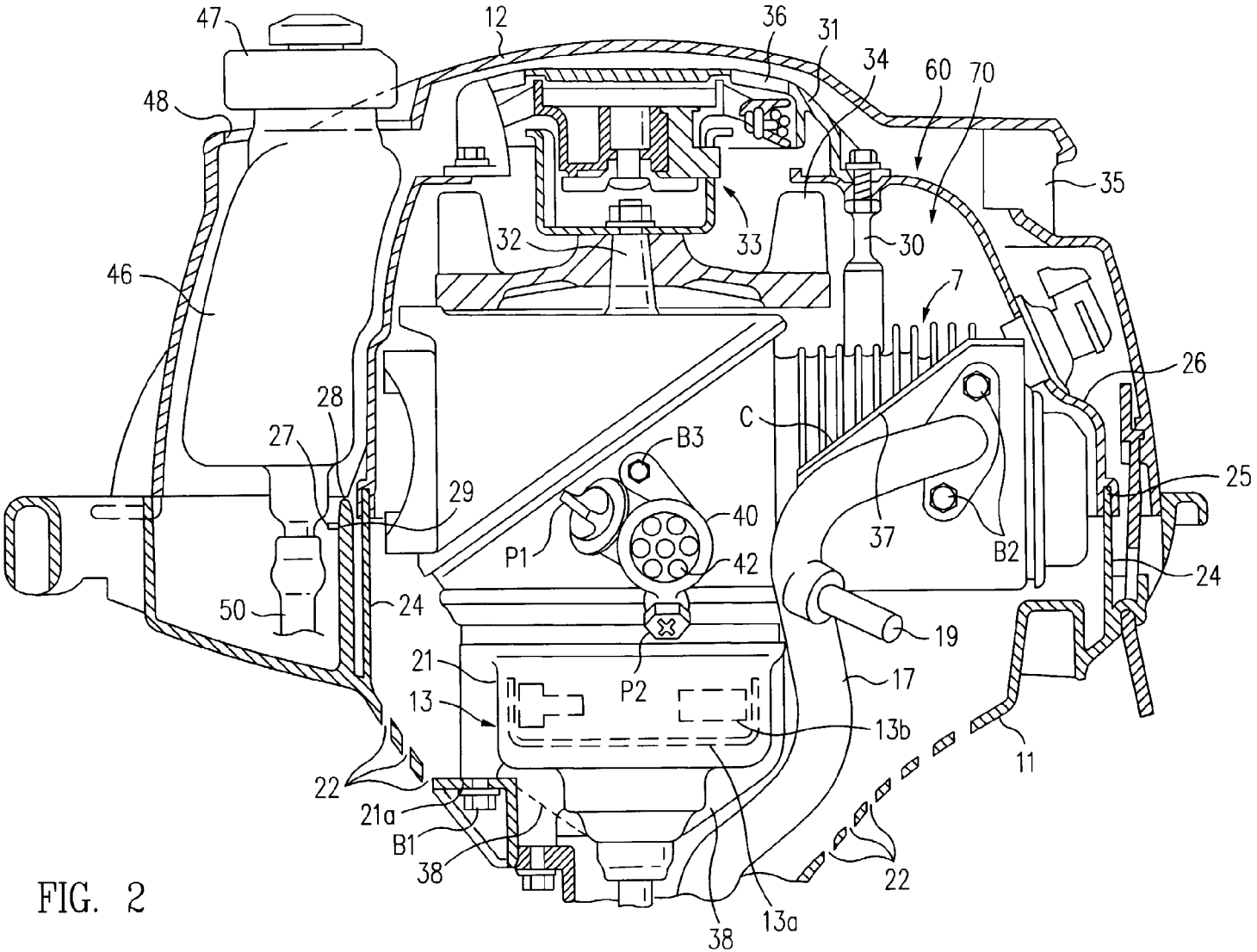
FIG. 2 is a partly broken-away side view of the engine and the surrounding arrangement.

The engine 7 consists of a vertical-crankshaft, air-cooled, single-cylinder, four-stroke internal combustion engine, and is generally covered by an under case 11 and an engine cover 12 which are detachably joined with each other. The cylinder head of this engine is directed rearward with a slight angular offset to one side. The lower end of a crankshaft 32 FIG. 2) of this engine 7 is connected to the upper end of the drive shaft 5 via a known centrifugal clutch device 13. The under case 11 is attached to the bottom surface of a housing of the centrifugal clutch device 13 so that the engine cover 12 may be removed while the under case 11 is kept attached to the engine 7.

Figure 3:
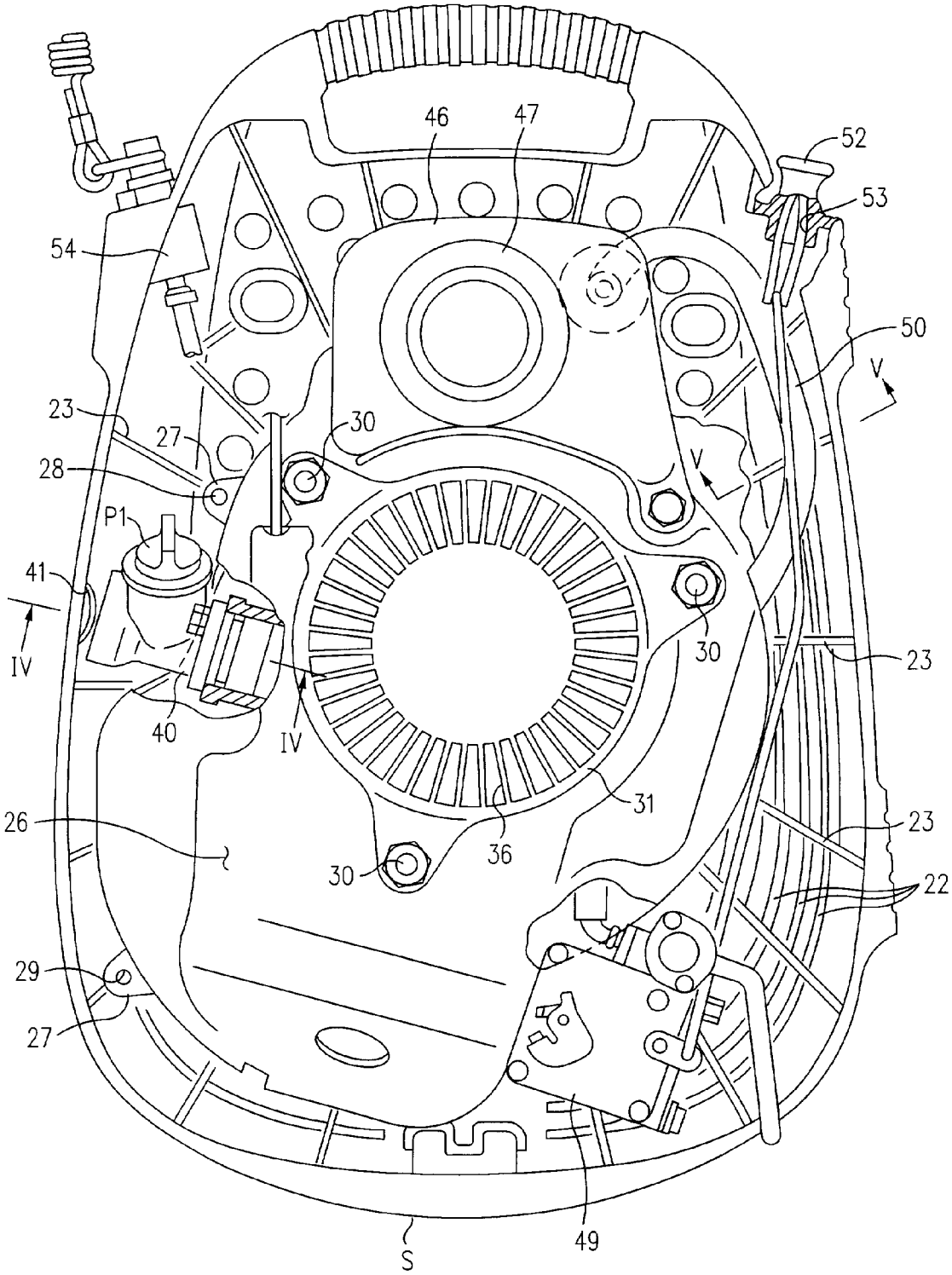
FIG. 3 is a partly broken-away plan view of the outboard marine drive with its engine cover removed for showing the part surrounding the engine.
Figure 4:
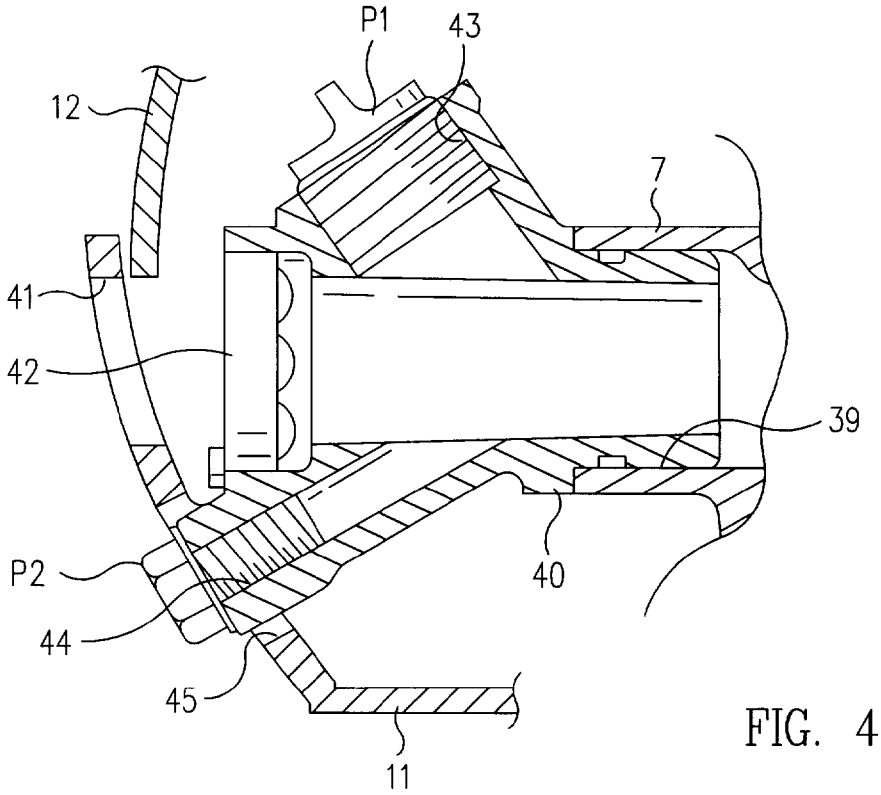
FIG. 4 is a fragmentary sectional view taken along line IV—IV of FIG. 3.

The housing of the centrifugal clutch device 13 is provided with an arm (not shown in the drawings) which extends out of the under case 11, and a free end of this arm is attached to a steering arm 14 which can turn in a horizontal plane. By thus angularly moving the steering arm 14, the outboard marine drive main body can be turned around a vertical axis for steering the boat A free end of the steering arm 14 is provided with a throttle grip 15 for operating a throttle valve of a carburetor 49 (FIG. 3). When the rotational speed of the engine 7 is increased beyond a certain level by suitably twisting the throttle grip 15, the centrifugal clutch device 13 is engaged, and the rotational power of the crankshaft is transmitted to the propeller 16 via the drive shaft 5 and the propeller shaft 9.

An exhaust pipe 17 has an upper end 17*a* which is connected to an exhaust port of the cylinder block, and extends from the engine room into the extension case 6 along a curved path. The lower end 17*b* of the exhaust pipe 17 terminates at a point adjacent to the lower end 6*b* of the extension case 6. The exhaust pipe 17 extends substantially in parallel with the drive shaft 5 inside the extension case 6, and its lower end 17*b* is supported by a circular partition member 18 which is made of resilient elastomeric material and fitted into a bore defined at the lower end 6*b* of the extension case 6. An inlet opening 19 is provided in a curved part of the exhaust pipe 17 adjacent to the cylinder block for receiving a probe for analyzing the contents of the exhaust gas.

The exhaust gas from the engine 7 is released from the lower end 17*b* of the exhaust pipe 17, and is normally released into the water from an opening 20 defined in the interface between the extension case 6 and the gear case 10. The exhaust gas is then pushed rearward in the water by the water flow produced by the propeller 16. Because the interior 6*a* of the extension case 6 is separated from the lower part thereof by the partition member 18, the exhaust gas is prevented from flowing upward inside the extension case 6.

Now is described the part of this outboard marine drive associated with the engine 7 referring to FIGS. 2 to 5. The engine 7 is covered jointly by the under case 11 and the engine cover 12 as mentioned earlier, and the under case 11 is secured to the lower surface 21*a* of the clutch housing 21 by bolts B1 while the engine cover 12 is detachably attached to the open end of the under case 11. The inner bottom surface of the under case 11 is provided with a number of slots 22 for ventilation, and a number of reinforcement ribs 23 extending radially from the axial center of the crankshaft The under case 11 is further provided with a substantially cylindrical upright wall 24 surrounding a lower part of the engine 7. In fact, the upright wall 24 has a profile which closely surrounds the lower part of the engine.

A fan cover 26 is placed over an upper part of the engine 7, and is held in place by virtue of a U-shaped groove 25 formed in the lower edge thereof receiving an upper edge of the upright wall 24. The mutually abutting edges of the fan cover 26 and the under case 11 are conformally profiled as can be readily appreciated. The lower edge of the fan cover 26 is provided with a plurality of tabs 27, and locator pins 28 standing upright from the bottom surface of the under case 11 fit into 29 holes provided in these tabs 27 for properly positioning the fan cover 26 relative to the under case 11 against any lateral movement.

The fan cover 26 is firmly secured to the engine 7, along with a recoil starter 31 placed over the engine 7, by stud bolts 30 extending from the engine 7. Thus, the engine cover 12 and the under case 11 jointly defines a first chamber 60, and the fan cover 26 and the lower case 11 jointly defines a second chamber 70 inside the first chamber 60. The recoil starter 31 is connected to the upper end of the crankshaft 32 of the engine 7 via a coupling 33 which engages and disengages through an axial movement of an engagement member. The upper end of the crankshaft 32 is also provided with a centrifugal cooling air fan 34 serving also as a flywheel so that when the crankshaft 32 is turning, air introduced from air inlets formed along an outer periphery of an upper rear part of the engine cover 12 is drawn into the fan cover 26 via openings 36 formed in the upper wall of the cover of the recoil starter 31, and after cooling the engine, is expelled from the housing assembly from ventilating slots 22 formed in the bottom wall of the under case 11.

An air guide plate 37 having in inclined surface C inclining downward toward the crankcase is attached to a side of the cylinder block of the engine 7.

This air guide plate 37 is formed by an extension of a metal gasket interposed between the cylinder block and the flanged end of the exhaust pipe 17, and is secured by the bolts B2 which secure the exhaust pipe 17 to the cylinder block. Thus, the flow rate of the cooling air around the crankcase can be maximized without increasing the number of component parts or the amount of work required for the assembly work. Alternatively, the air guide plate may be integrally formed with the cylinder block or tie fan cover 26. The size of the gap between the inner surface of the fan cover 26 and the outer surface of the engine 7 can be appropriately selected so as to achieve a desired amount or speed of air flow at each selected location of the engine. Also, by providing cooling fins 38 on the outer circumferential surface of the clutch housing 21, it is possible to enhance the cooling of a clutch drum 13*a* and a clutch shoe 13*b* incorporated in the clutch housing 21.

A socket member 40 is fitted into an opening 39 defined in the crankcase of the engine 7 with the center of this opening substantially coinciding with a normal oil level in the crankcase. In this case, the opening 39 is formed on a port side of the crankcase, but may also be provided in a starboard side of the crankcase. The socket member 40 is provided with an inner end closely received in the opening 39 of the crankcase, and a tab having an opening through which a threaded bolt B3 is passed and threaded into a threaded bore of the crankcase so as to fixedly secure the socket member 40 relative to the crankcase- An outer end of this socket member 40 terminates adjacent to an access hole 41 formed in a side wall of the under case 11, and is fitted with a level gauge window 42 made of transparent plastic material.

The socket member 40 is additionally provided with a filler pipe 43 extending upwardly at an oblique angle and a drain pipe 44 extending downwardly at an oblique angle. These pipes 43 and 44 are normally closed liquid-tight by threaded plugs P1 and P2, respectively. The outer end of the filler pipe 43 can be exposed simply by removing the engine cover 12 as it is located above the open upper end of the under case 11. The outer end of the drain pipe 44 is passed through a circular opening 45 provided in the under case 11 immediately below the access opening 41 for the level gauge window 42 so that the plug P2 can be easily fitted and removed in and out of the drain pipe 44 from outside the under case 11.

Figure 5:
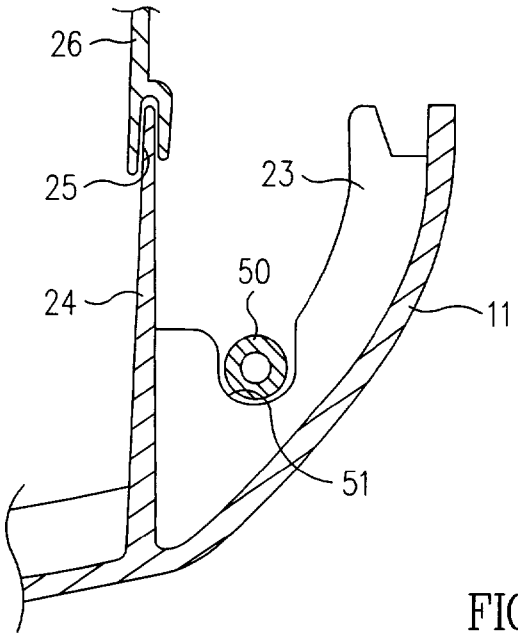
FIG. 5 is a fragmentary sectional view taken along line V—V of FIG. 3.

Between the engine cover 12 on the side of the crankcase of the engine 7 and the fan cover 26 (or in the front end of the engine cover 12) is disposed a fuel tank 46 which is fixedly secured to the fan cover 26. The fuel tank 46 is provided with a filler cap 47 which projects from an opening 48 provided in an upper part of the engine cover 12 so that fuel can be filled into the fuel tank 46 without removing the engine cover 12. A hose 50 for supplying fuel from the fuel tank 46 to the carburetor 49 which is attached to the cylinder head side (rear end) of the engine 7 is passed inside the under case 11. The hose 50 is positioned in the under case 11 by being fitted into U-shaped notches 51 provided in the radial ribs 23 at suitable locations as best illustrated in FIG 5.

A choke knob 52 attached to a choke lever of the carburetor 49 is directly engaged by an opening 53 provided in the under case 11 so as to apply a suitable frictional retaining force thereto while minimizing the number of component parts and the amount of work required for assembly.

The outer profile S of the under case 11 on the side of the cylinder head is generally circular with its center of curvature offset from the center of gravity of the engine toward the cylinder head. Therefore, even when the outboard marine drive is placed with its cylinder head down (typically in storage) on the floor, because the center of gravity of the engine is located above the center of curvature of the outer profile S, the engine rolls either way until either side thereof is always oriented horizontally, and the lubricating oil is prevented from remaining in the cylinder head. As is well known in the art, filling the combustion chamber with lubricating oil over time is harmful for the durability of the engine. If the outer profile of the rear end or the cylinder head end of the engine assembly is not circular, the profile of the engine assembly and the positioning of the gravitational center should be so selected in such a manner that the orientation of the assembly with its cylinder head facing down is unstable when placed on a floor, and the engine assembly rolls over the floor until either side thereof faces down. Numeral 54 denotes a kill switch Thus, according to the above described embodiment of the present invention, the level of engine lubricating oil can be easily inspected by viewing the level gauge window 42 through the access hole 41. Filling of lubricating oil can be equally readily accomplished by removing the plug P1 and pouring lubricating oil from the thus exposed outer end of the filler pipe 43. Draining of lubricating oil can be accomplished by removing the outboard marine drive from the boat and tilting it with the oil drain pipe 44 facing downward and the plug P2 removed therefrom. Therefore, draining of lubricating oil can be accomplished without removing the engine cover. Draining of lubricating oil can be also accomplished while keeping the outboard marine drive attached to the boat by tilting the outboard marine drive with its lower end up and twisting the outboard marine drive around the swivel case 4 so as to face the side of the outboard marine drive fitted with the socket member 40 downward. Therefore, draining of lubricating oil can be accomplished without removing the engine cover while keeping the outboard marine drive attached to the boat.

Although the present invention has been described in terms of a preferred embodiment thereof, it is obvious to a person skilled in the art that various alterations and modifications are possible without departing from the scope of the present invention which is set forth in the appended claims.

We claim:

1. An outboard marine drive having an internal combustion engine covered by an engine cover, comprising:

an opening formed in a crankcase of said engine centered to a normal lubricating oil level of said engine;

a tubular socket member sealingly connected to said opening of said crankcase; and a transparent window member sealingly fitted into an outer end of said tubular socket member;

wherein said engine cover is provided with an opening aligned with said transparent window member to allow a level of lubricating oil in said crankcase to be inspected from outside said engine cover.

2. An outboard marine drive according to claim 1, further comprising an oil filler pipe integrally and upwardly bifurcating from said socket member at an oblique angle.

3. An outboard marine drive according to claim 2, further comprising an oil drain pipe integrally and downwardly bifurcating from said socket member at an oblique angle.

4. An outboard marine drive according to claim 3, wherein said engine cover comprises an under case attached to a lower part of said engine, and an outer end of said drain pipe at least slightly projects from an opening formed in said under case.

5. An outboard marine drive according to claim 1, wherein said socket member comprises an inner end sealingly fitted into said opening of said crankcase, and a flange having an opening through which a threaded bolt is threaded into a corresponding threaded hole of said crankcase.

* * * * *